US005427068A

United States Patent [19]

Palmer

[11] Patent Number: 5,427,068

[45] Date of Patent: Jun. 27, 1995

[54] ROTARY COMPRESSOR AND ENGINE MACHINE SYSTEM

[75] Inventor: William R. Palmer, Melbourne, Fla.

[73] Assignee: Spread Spectrum, Melbourne, Fla.

[21] Appl. No.: 940,446

[22] Filed: Sep. 4, 1992

[51] Int. Cl.[6] ..... F02B 53/00

[52] U.S. Cl. ..... 123/204; 123/236; 123/247; 60/39.55; 418/235; 418/241

[58] Field of Search ..... 418/259, 260, 235, 241; 123/204, 236, 247; 60/39.55

[56] References Cited

U.S. PATENT DOCUMENTS

| | | | |
|---|---|---|---|
| 993,530 | 5/1911 | Kinney | 418/235 |
| 2,071,799 | 2/1937 | Mabille | 418/235 |
| 3,713,426 | 1/1973 | Jensen | 123/236 |
| 3,747,573 | 7/1973 | Foster | 418/260 |
| 3,819,308 | 6/1974 | Ishihara et al. | 418/241 |
| 3,971,346 | 7/1976 | McReynolds | 123/236 |
| 3,989,011 | 11/1976 | Takahashi | 123/204 |
| 4,061,450 | 12/1977 | Christy | 418/259 |
| 4,553,513 | 11/1985 | Miles et al. | 123/204 |
| 4,631,914 | 12/1986 | Hines | 60/39.55 |
| 4,928,478 | 5/1990 | Mastak | 60/39.55 |

FOREIGN PATENT DOCUMENTS

| | | | |
|---|---|---|---|
| 0535906 | 11/1955 | Italy | 418/259 |
| 1382602 | 2/1975 | United Kingdom | 123/204 |

*Primary Examiner*—Richard A. Bertsch

*Assistant Examiner*—Charles G. Freay

*Attorney, Agent, or Firm*—Charles Wands

[57] ABSTRACT

A rotary device employs an outer housing having an interior surface with a central axis associated therewith, an outer hub assembly, disposed inside said outer housing, having a central axis associated therewith located at a distance from the central axis of the outer housing, an inner hub, disposed inside the outer hub assembly, having a central axis associated therewith and being substantially coaxial with the outer housing, and a plurality of blades, hingedly connected at one end to the inner hub and radiating through the outer hub assembly, whereby a plurality of relatively airtight compartments are formed between the interior surface of the outer housing, the outer hub assembly, and pairs of blades, with the volume of said compartments varying as a function of the rotative position of the inner hub and outer hub assembly. The rotary device can be used as a compressor having an inlet for receiving fresh air and an outlet for providing compressed air, The rotary device can also have an inlet for receiving working fluid, an exhaust for venting working fluid, a combustor for burning gases in a combustion chamber, and a compressor for providing compressed air to said combustor. The combustor can also heat an expansion gas which is mixed with the burning gas before being provided to the inlet.

17 Claims, 11 Drawing Sheets

ROTARY COMPRESSOR AND ENGINE MACHINE SYSTEM

BACKGROUND AND SUMMARY OF THE INVENTION

This invention relates to the field of rotary machines and more particularly to the field of rotary compressors and continuous combustion rotary engines.

Combustion engines use pressurized working fluid, such as expansion gases and/or combustion gases, to impart rotating motion to a shaft. In the case of a reciprocating piston driven engine, combustion gases explode to drive a piston thereby causing rotation of a crankshaft. For a gas turbine engine (Brayton Cycle Engine), pressurized combustion gases that are provided to blades connected to a shaft cause the shaft to rotate. Similarly, for a steam turbine engine (Rankine Cycle Engine), a shaft is rotated by providing pressurized steam to blades connected to the shaft.

A drawback to the reciprocating piston engine is that the sudden and extreme force placed on the pistons by the expanding combustion gases (nominally 400 to 600 p.s.i. at 2000 r. p.m.) tends to cause fatigue in the moving parts. Furthermore, the intermittent burning of fuel in the cylinders is relatively inefficient compared to burning fuel continuously and incomplete burning is a primary cause of pollutants. Also, much of the energy in a piston engine is radiated as heat and hence lost.

A turbine rotary engine (Rankine or Brayton cycle) overcomes the problem of sudden and extreme force associated with reciprocating piston engines by providing to the blades a continuous stream of working fluid at a relatively constant pressure. However, turbine engines are subject to a phenomena called "blade slip" wherein working fluid passes over and past the blade without doing any physical work. In order to minimize blade slip, turbine engines are operated with relatively high fluid pressures, thereby limiting the adjustability of the operating range of the turbine engines. For example, for some steam turbine engines, effecting a speed adjustment can take as long as an hour and a half.

Sliding vane machines have blades attached to a hub and arranged perpendicular to the direction of rotation. The blades rotate inside a non-circular housing. The blades are capable of expanding and contracting longitudinally so that compartments formed by pairs of blades, the hub, and the interior surface of the housing have a variable volume, thereby allowing for compression and expansion of the working fluid. This arrangement addresses the sudden and uneven combustion problems of piston engines and overcomes the "blade-slip" problem associated with turbine engines.

However, the amount of work that can be performed by the working fluid varies according to the compression ratio (i.e. the ratio of greatest to smallest compartment volume) which, for a sliding vane turbine, is relatively low and usually does not exceed approximately three to one.

An object of the present invention is to overcome the above-mentioned problems and to provide compact energy efficient rotary machines and engine systems utilizing same.

According to preferred embodiments of the present invention, a rotary machine is provided which includes an outer housing having a predetermined curvilinear interior surface with an outer housing central axis associated therewith. A rotatable outer hub assembly is disposed inside the outer housing and has an outer hub assembly central axis associated therewith located at a distance from the outer housing central axis. An inner rotatable hub is disposed inside the outer hub assembly and has an inner hub central axis associated therewith which is substantially coaxial with the outer housing central axis. A plurality of blades are hingedly connected at one end to the inner hub and radiate through the outer hub assembly to contact the interior surface of the outer housing at the other end of the blades. Thus a plurality of relatively airtight compartments are formed between the interior surface of the outer housing, the outer hub, and respective pairs of the blades. During operation, the volume of the compartments varies according to the rotational angle of the respective pairs of blades.

Due to the fixing of the radial inner ends of the blades at the inner hub and the offset of the axes of the inner hub and outer hub assembly, the blades are precisely controlled to progressively change their angular orientation and therewith the size of the compartment volumes for each rotational cycle of operation. The interior surface of the outer housing is configured to match the location of the blade outer tips as both the inner and outer hubs are rotated. Thus, the blades need not and do not slide or expand radially, but rather, are precisely positively controlled by their connection to the inner hub and their sliding engagement at the outer hub.

In operation, the rotary machine transfers forces between the blades and the inner hub by way of the outer hub assembly forming effective abutments for the blades acting as levers. When the rotary machine is operated as part of an engine, motive pressurized fluid acts on the blades to cause them to move and push the outer hub assembly which is drivingly connected to rotate together with the inner hub. The angular orientation of the blades from radial is constantly changed in dependance on the rotative position of the outer hub assembly due to the offset at the outer hub assembly with respect to the inner hub and the effective "sliding" fulcrum at the locations where the blades radially extend through the outer hub assembly. Coupled with this angular change in the blades are changes in the effective pressure area of the blades and in the volumes between the blades discussed in more detail elsewhere herein.

When the rotary machine is operated as a compressor, the inner hub is rotated, which drivingly rotates the outer hub assembly, causing the blades to operate to compress fluid supplied thereto.

When serving as part of an engine, the rotary machine has an inlet for receiving working fluid and an exhaust for venting working fluid. The incoming working fluid is pressurized and acts on the blades to move the blades, which are drivingly engageable with the outer hub assembly. A drive transmission connects the outer hub assembly and inner hub such that the inner hub, and an output shaft connected thereto, is rotatably driven. In especially preferred embodiments, the inner hub and outer hub assembly rotate at the same rotational velocity. A combustor is provided for burning gases in a combustion chamber which are provided as working fluid to the inlet of the rotary machine. In a preferred machine embodiment, a compressor is provided for providing compressed air to the combustor. The combustor also heats an expansion gas which is mixed with the burning gas before being provided in the inlet.

In a preferred embodiment of the invention, the compressor is constructed as a second rotary machine which is substantially similar to the first rotary machine and is connected by a common drive shaft.

In certain preferred embodiments, the rotary machine has grooves cut into the interior surface of the outer housing for allowing working fluid in one compartment to pass through to another adjacent compartment.

In especially preferred embodiments of the present invention, the rotary machine is operated by providing to the inlet an expanding working fluid containing a predetermined amount of a combusted gas and a predetermined amount of an expansion gas. The amounts can also be varied during operation. Also, oxygen can be added to the combustion gas during combustion according to contemplated preferred embodiments.

Advantages of the present invention include increased fuel efficiency, reduction of emissions of pollutants, simple design, light weight, and small size. The invention can advantageously be operated closed cycle, open cycle, or a combination thereof. The invention can simultaneously utilize two types of working fluid: combustible gases and expansion gases. The amount of each can be varied during operation depending upon the availability of each and the load placed on the rotary machine system. Furthermore, the rotary machine of the present invention is advantageously adaptable to continuous combustion which provides for less noise than explosive, piston-driven engines and less wear on moving parts. Also, equalization of forces on the blades results in decreased eccentric loading on the moving parts.

Certain preferred rotary machine engine arrangements of the present invention are especially fuel efficient because heat produced by combustion, which would otherwise be radiated and lost, is used to heat an expanding working fluid, such as steam. The substantial compression ratio obtainable according to preferred embodiments of the invention allows for substantial work to be performed by the expansion gases. Since the compartments between the blades are relatively airtight, the problem of blade slip, which is usually associated with rotary turbine engines, is eliminated.

Other objects, advantages and novel features of the present invention will become apparent from the following detailed description of the invention when considered in conjunction with the accompanying drawings.

DETAILED DESCRIPTION OF THE DRAWINGS

Figure 1:
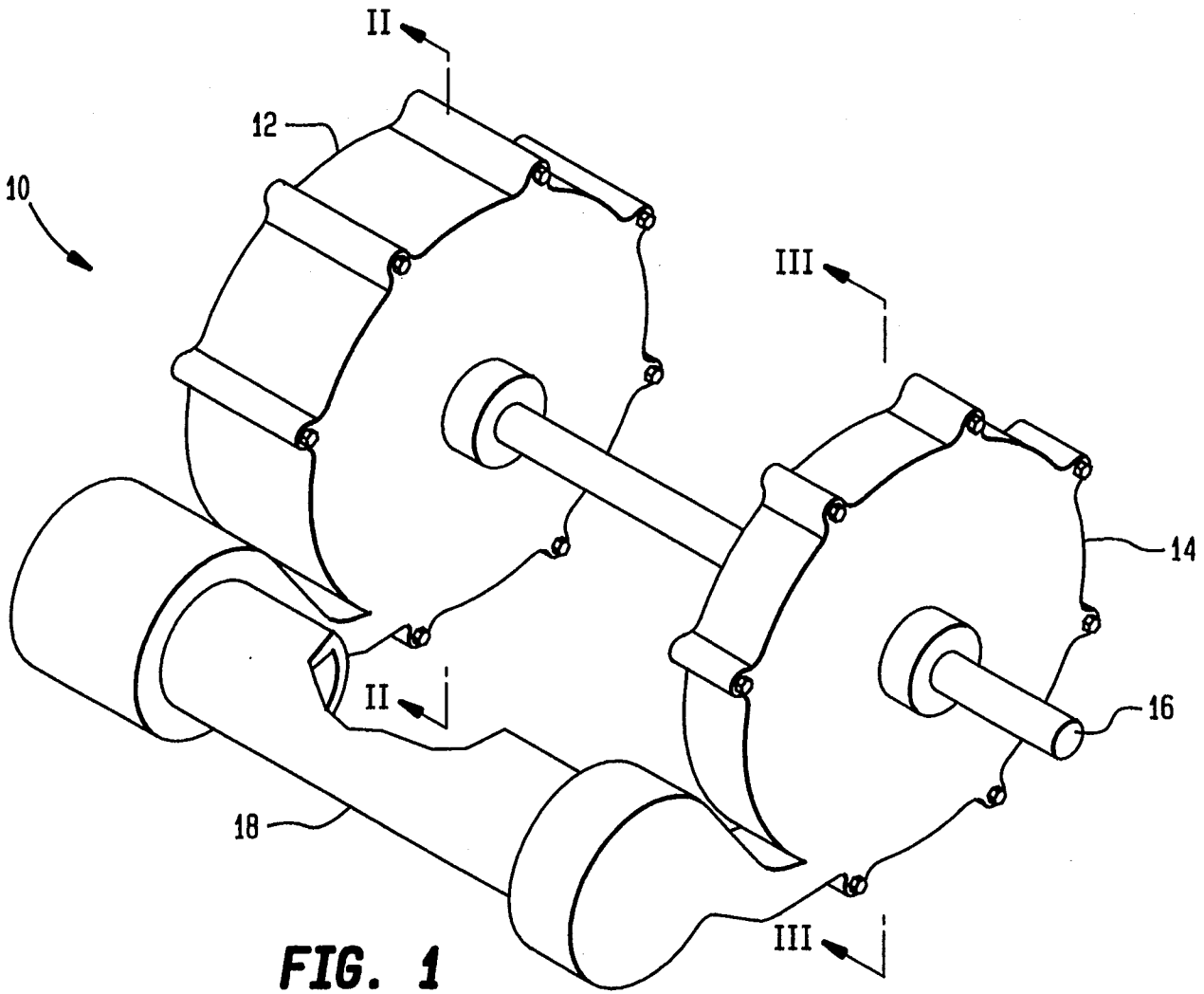
FIG. 1 is a schematic perspective view of a high pressure continuous combustion rotary engine system constructed according to a preferred embodiment of the invention.

Referring to FIG. 1, a high pressure continuous combustion rotary engine system 10 comprises an expander 12 and a compressor 14. The expander 12 and the compressor 14 share a common rotating shaft 16. The compressor 14, which is driven by the shaft 16, takes in fresh air which is compressed and provided to a combustor 18, where the compressed air is mixed with combustible fuel and/or steam, expanded, and then provided to the expander 12 which uses the energy of the output working fluid of the combustor 18 to perform work and rotate the shaft 16.

Figure 2:
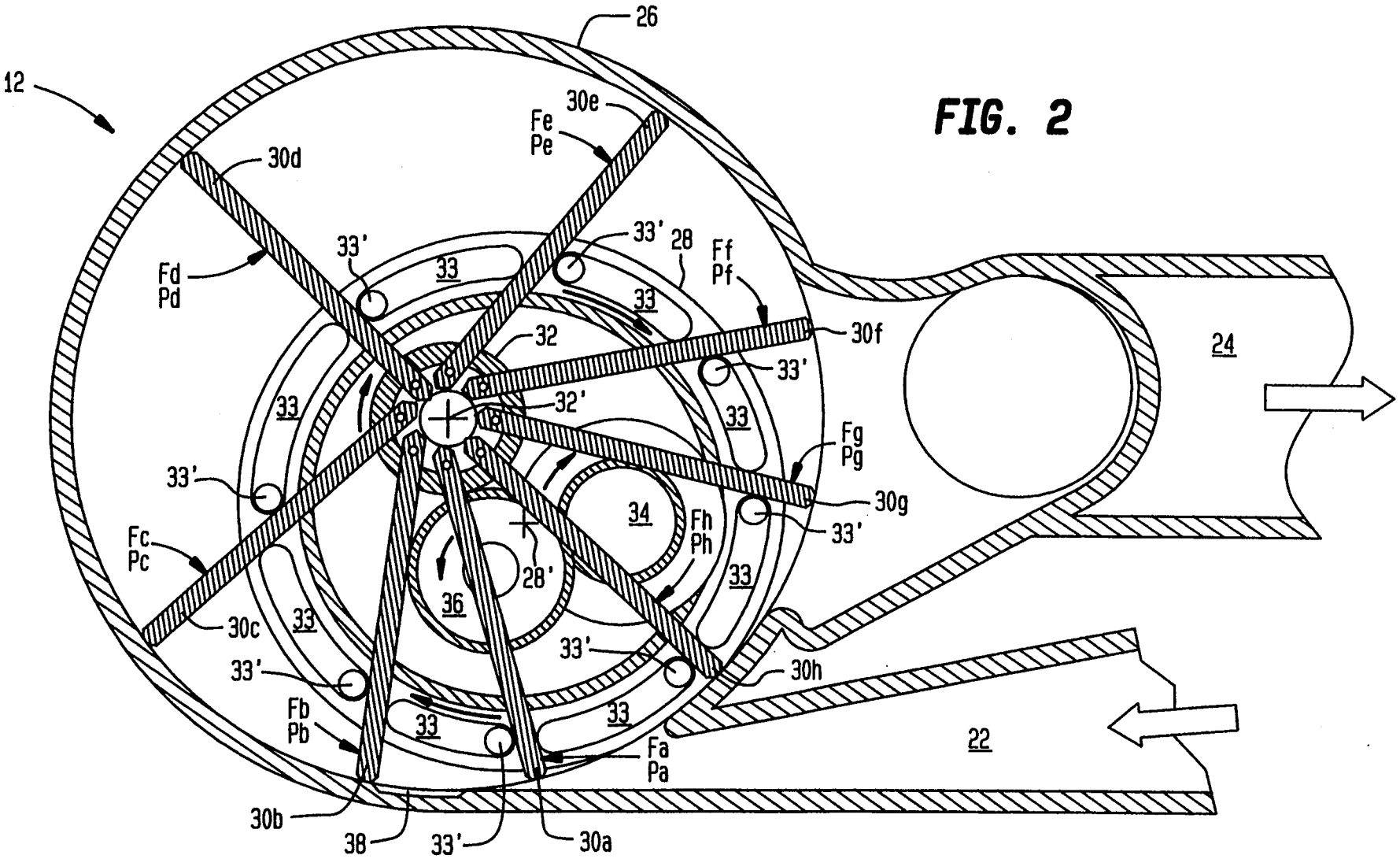
FIG. 2 is a sectional schematic view taken along line II—II of FIG. 1 and illustrating a rotary machine expander for the engine system of FIG. 1.

Referring to FIG. 2, the expander 12 has an inlet 22 for receiving working fluid and an exhaust 24 for expelling the received working fluid. The expander 12 is enclosed by an outer housing 26. The outer housing 26 also contains an outer hub assembly 28 and a plurality of blades **30*a*–30*h* which extend radially from an inner hub 32 having a central axis 32'. The outer hub assembly 28 has a central axis 28'. A plurality of outer hub spreaders 33 are part of the outer hub assembly 28 and are positioned between the blades 30*a*–*h*. The outer hub assembly 28, therefore, comprises a pair of hub rings on each end which are interconnected by the spreaders 33. The blades 30*a*–*h* radiate through the outer hub assembly 28 between the spreaders 33**.

The central axis 32' of the inner hub 32 coincides with a central axis of a substantially circular shape defined by the inside surface of the outer housing 26. The central axis 28' of the outer hub assembly 28 is offset from the central axis 32' of the inner hub 32. The shaft 16 shown in FIG. 1 is connected to the inner hub 32. The blades **30*a*–*h* can be made of a light weight, strong material such as a graphite matrix composite, aluminum, or any other suitable material. Although eight blades 30*a*–*h*** are shown, other embodiments of the invention are contemplated using a different number of blades.

The blades **30*a*–*h* are hingedly connected to the inner hub 32 by blade end bearing assemblies 31 which comprise a shaft having bearings on each end. A number of other acceptable bearing configurations could be used for hingedly connecting the blades 30*a*–*h* to the inner hub 32. The central axis 32' coincides with the central axis of the shaft 16 of FIG. 1**.

The outer hub assembly 28 has disposed therein the inner hub 32, a first gear 34 having teeth that mesh with teeth on the inner surface of the outer hub assembly 28, and a second gear 36 having teeth that mesh with teeth on the first gear 34 and with teeth on the inner hub 32. The outer hub assembly 28, the first gear 34, the second gear 36, and the inner hub 32 rotate in concert. Arrows drawn thereon indicate the relative directions of motion. Also, the gearing is such that the inner hub 32 rotates once for every rotation of the outer hub assembly 28. The outer hub assembly 28, the inner hub 32, and the gears 34, 36 are held in place by the housing 26.

Expanding gasses arriving at the inlet 22, press against the blades 30*a–h* which press against the hub spreaders 33 of the outer hub assembly 28 causing clockwise rotation of the outer hub assembly 28 and the inner hub 32. The blades 30*a–h* are hingedly attached to the inner hub 32 (i.e. the blades 30*a–h* are attached at a single point to the inner hub 32) at a common radius by the blade end bearings 31, thus facilitating the change of angle, in the radial direction, of the blades 30*a–h* with respect to the inner hub 32 during rotation. The motion of the blades 30*a–h* in and out of the outer hub assembly 28 during rotation of the outer hub assembly 28 is facilitated by rollers 33' placed on the ends of the hub spreaders 33. The rollers 33' can be made of stainless steel or any other suitable material.

As the rotative position of the inner hub 32 changes, the area of the blades 30*a–h* between the outer hub assembly 28 and the interior wall of the outer housing 26 also changes. Since the width of the blades is constant, and since area equals width times length, then the area of any of the blades 30*a–h* between the outer hub assembly 28 and the outer housing 26 will be proportional to the length of the blade between the outer hub assembly 28 and the outer housing 26.

The change in the angle of the blades 30*a–h* with respect to the inner hub 32 during rotation causes the outer tips of the blades 30*a–h* to define a shape that is not exactly circular. The interior surface of the outer housing 26 conforms with that shape.

Seals on the free ends of the blades 30*a–h* touch the inner surface of the outer housing 26. The pressing force of the ends of the blades 30*a–h* with respect to the interior surface of the housing 26 is relatively small in order to minimize wear at the ends of the blades 30*a–h*. The blades are sealed at the ends and each side with a suitable material such as a Teflon or graphite matrix composite or any other suitable material which resists wear and has good thermal properties. The seals can be part of the blades 30*a–h* or can be removable.

Operation of the expander 12 is illustrated by showing force on the blades 30*a–h* and pressure in a plurality of relatively airtight compartments which are formed between pairs of the blades 30*a–g*, the inner surface of the outer housing 26, and the hub spreaders 33 on the outer hub assembly 28. Compressed gas having a pressure Pa enters the expander 12 through the inlet 22 and acts on a portion of the blade 30*a* between the outer hub assembly 28 and the outer housing 26 (i.e. the portion of the blade 30*a* sticking out of the outer hub assembly 28) having an area designated as Aa.

A compartment is formed between the blade 30*a*, the blade 30*b*, the hub spreader 33 of the outer hub assembly 28, and the inside surface of the outer housing 26. The pressure inside the compartment is Pb. The force on the blade 30*a*, Fa, can therefor be calculated by the following equation:

$$Fa=(Pa-Pb)*Aa$$

Similarly, the compartment formed between the blade 30*b*, the blade 30*c*, the outer hub assembly 28 and the outer housing 26 has a pressure Pc. Note that the volume of the compartments formed between the blades 30*a–h* varies according to rotational angle and that the compartment between the blades 30*b*, 30*c* has a larger volume than the compartment between the blades 30*a*, 30*b*. Assuming for the moment that the temperature of the two compartments is approximately the same, then using identity PV=nRT yields the following:

$$PbVb=PcVc$$

Also, since the Vc is greater than Vb, then, for the above equation to be true, Pc is less than Pb. Therefore, the force Fb on the blade 30*b* is positive, i.e. is acting in the direction shown since the pressure, Pb, on one side of the blade 30*b* is greater than the pressure, Pc, on the other side of the blade 30*b*. In other words, the quantity (Pb−Pc) is positive because the volume Vc is greater than the volume Vb. The force on the blade 30*b* is given by the equation:

$$Fb=(Pb-Pc)*Ab$$

where the area of the blade 30*b* between the outer hub assembly 28 and the outer housing 26 is Ab.

The forces on the remainder of the blades can be calculated in a similar manner. Note that the area of the blades 30*a–h* is a function of the rotative positions of the inner hub 32 and the outer hub assembly 28. Note also that the area of the blades 30*a–h* generally increases going from rotative positions at the inlet 22 to rotative positions at the exhaust 24.

The pressurized fluid is vented through the exhaust 24 at the compartment between the blade 30*e* and the blade 30*f*. Therefore, the pressure in the compartment formed between the blades 30*e*, 30*f* and the pressure in the compartment formed between the blades 30*f*, 30*g* and the compartment between the blades 30*g*, 30*h* is approximately equal to atmospheric pressure. There is negligible pressure force for performing work on the blades 30*f*, 30*g*, 30*h*.

The force on the blades 30*a–e* is proportional to the pressure differential (i.e. the expansion ratio) between the compartments. The expander 12 can have an expansion ratio in excess of twenty to one, thereby providing for substantial pressure differentials and hence allowing substantial force to be generated on the blades 30*a–e*.

The change in volume, and hence the change in pressure, of the compartments as the blades 30*a–h* change rotative position is a function of relative physical dimensions of parts of the expander 12 such as the diameter of the outer hub assembly 28, the diameter of the outer housing 26, and the distance between the central axes 28', 32' of the outer hub assembly 28 and the inner hub 32. The forces on each of the blades 30*a–e* can be controlled, therefore, by controlling the dimensions of the expander 12.

There are geometric properties associated with the dimensions of the expander 12. The radius of the outer hub assembly 28 can be no smaller than the sum of the radius of the inner hub 32 and the distance between the axes 28', 32'. Note that as the radius of the outer hub assembly 28 becomes a larger proportion of the radius of the outer housing 26, the expansion ratio also decreases. Similarly, as the axes 28', 32' becomes closer, the expansion ratio decreases.

It is desirable to equalize the force on the blades 30*a–e* for the portions of the stroke which precede the exhaust 24 in order to provide a more uniform torque on the outer hub assembly 28, thereby minimizing eccentric loading of moving parts of the expander 12. The pressure differentials can be finely adjusted by cutting grooves 38 in the interior surface of the outer housing 26 which allow a certain amount of the pressure in one compartment to be vented to the next compartment. Note, however, that equalizing the forces on the blades 30*a–e* is not essential to the invention and that the invention may be practiced with unequal forces on the blades 30*a–e*.

Figure 3:
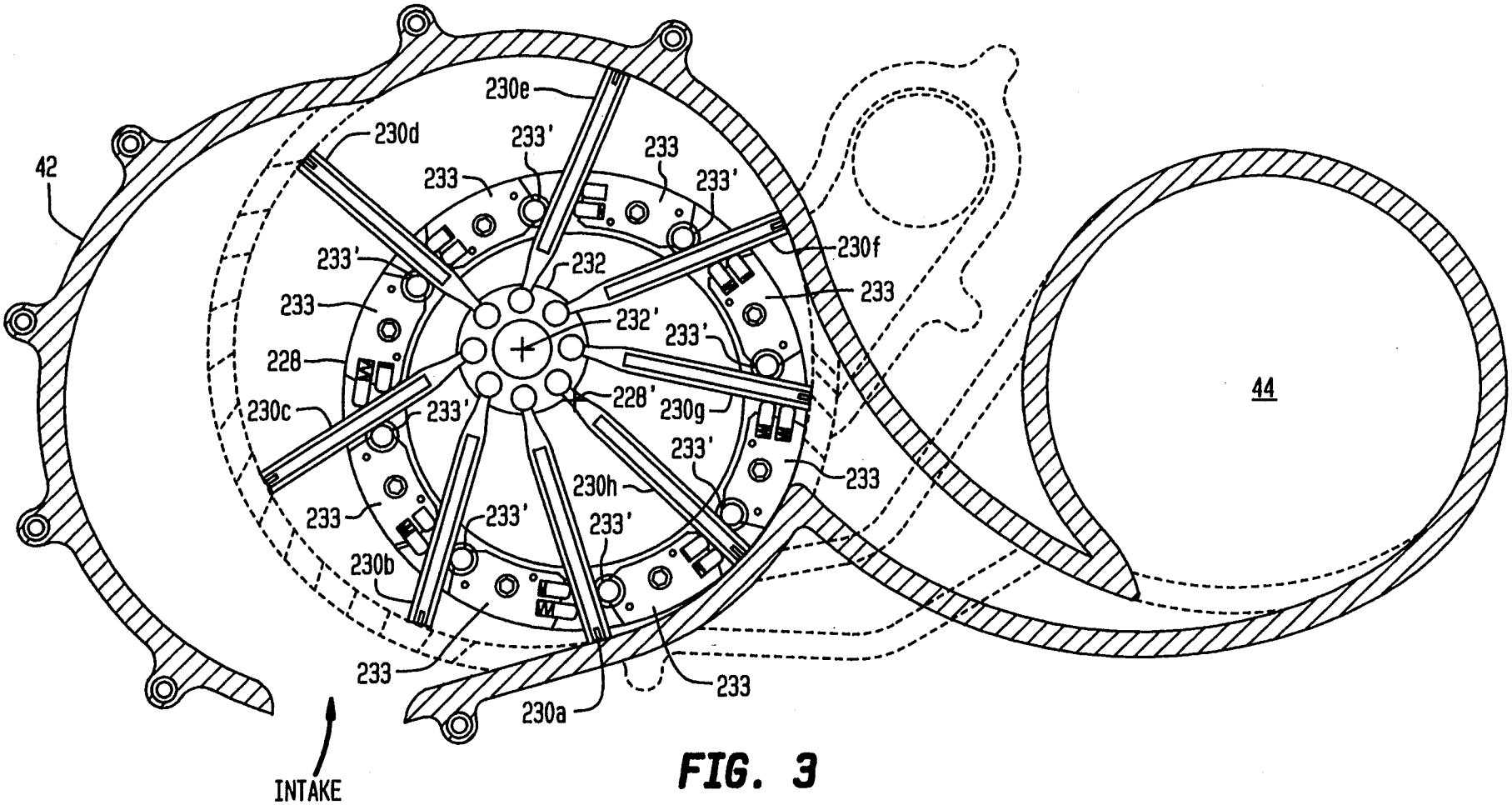
FIG. 3 is a sectional schematic view taken along line III—III of FIG. 1 and illustrating a rotary machine compressor for the engine system of FIG. 1.

Referring to FIG. 3, the compressor 14, which is also shown in FIG. 1, is very similar to the expander 12 shown in FIG. 2. The blades rotate to take in fresh air through a manifold 42. Arrows drawn on the moving parts indicate the relative directions of rotation.

Parts of the compressor 14 which are analogous to parts of the expander 12 are indicated with reference numerals that are 200 greater than the corresponding parts of the expander 12. The air is compressed as the volume of the compartments decreases during rotation. The compressed air is provided to a compression chamber 44. The shaft 16, shown in FIG. 1, is connected to the center hub 232 of the compressor 14 to drive the compressor 14, as explained above. The compressor 14 is driven by the shaft 16 which drives the inner hub 232. The outer hub assembly 228 can be driven directly from the expander outer hub assembly 28, thus eliminating the need for the gears inside the outer hub assembly 228. If, on the other hand, the compressor 14 is driven as a stand-alone unit, gears inside the outer hub assembly 228 would be needed.

It would be possible to drive the compressor 14 at a different speed than the expander 12 by providing gearing therebetween (instead of the common shaft 16) by means known to one skilled in the art.

Figure 4:
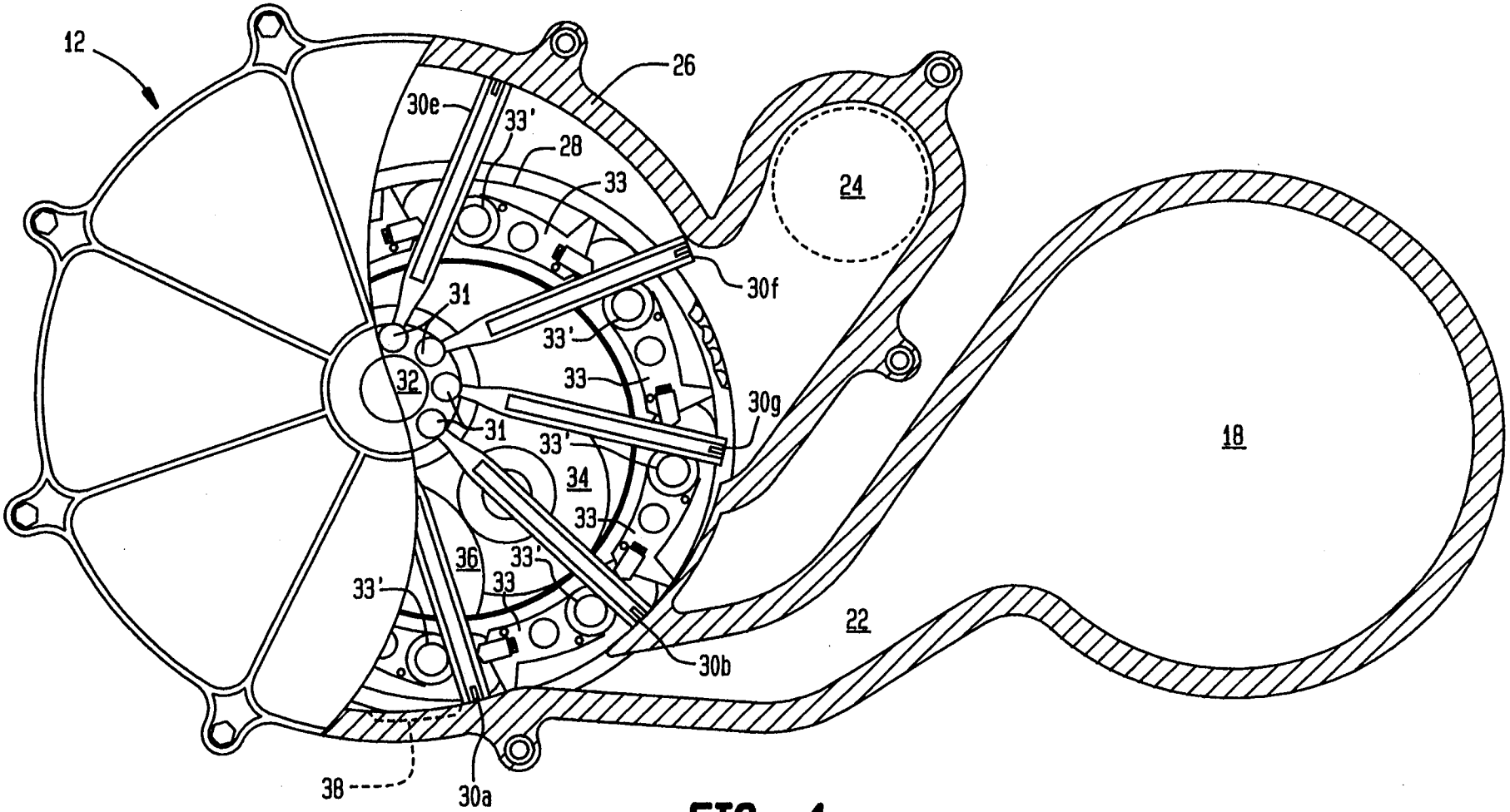
FIG. 4 is a detailed diagram of a rotary machine expander for the engine system of FIG. 1.

Referring to FIG. 4, the expander 12 is shown in more detail. The combustor 18 provides combustion gases which travel through the intake 22 and provide a force to push on the blades 30*a–h*. The force on the blades 30*a–h* presses against the hub spreaders 33 which have rollers 33' on the end receiving the force of the blades 30*a–h*. Pressing on the rollers 33' causes the outer hub assembly 28 to rotate, thereby turning the gears 34, 36 which rotate the inner hub 32 at the same rate as the outer hub assembly 28.

FIG. 4 shows the rollers 33' at the end of the hub spreaders 33. At the other end of the spreaders 33 are abutting seals for providing airtight sealing. Also shown herein are the blade end seals which contact the outer housing 26. The blade end bearing assemblies 31, on which the blades 30*a–h* rotate, are also shown in this figure.

Figure 5:
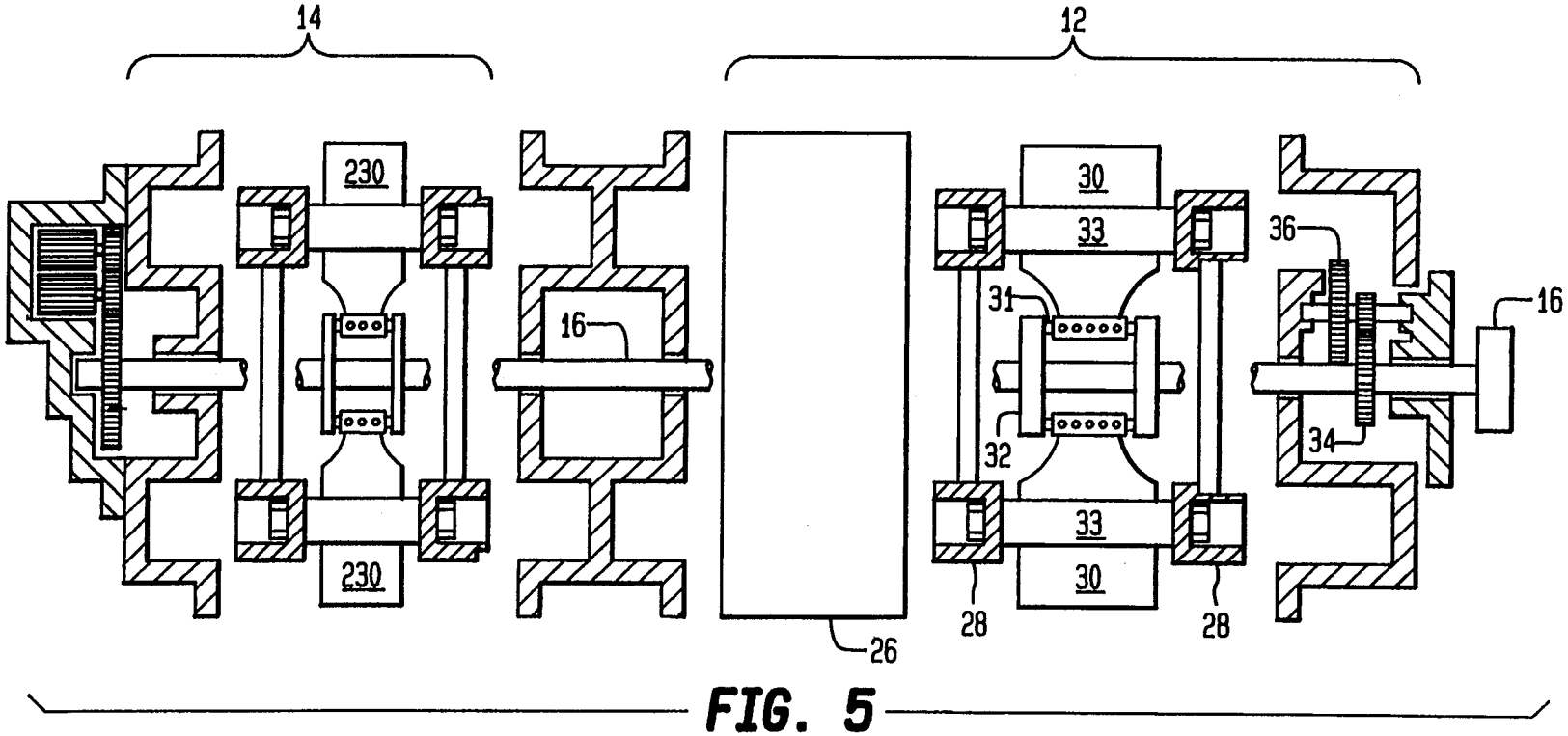
FIG. 5 is a pull-apart side view of the engine system of FIG. 1.

FIG. 5 shows a pull-apart assembly of the high pressure continuous combustion rotary engine system 10. The expander 12 is comprised of the outer housing 26, the outer hub assembly 28, the inner hub 32, the blades 30 being attached by the blade end bearings 31, the gears 34, 36, and the shaft 16. The compressor 14 is also shown in FIG. 5.

The width of the blades 230 of the compressor 14 are shown as being about ⅓ the width of the blades 30 of the expander 12. This occurs because the output of the compressor 14 is at the same pressure as the inlet of the expander 12. Since the force on the blades is the pressure times the area, then in order for the expander 12 to do positive work, the blade area of the compressor 14 must be less than the blade area of the expander 12.

Figure 6A:
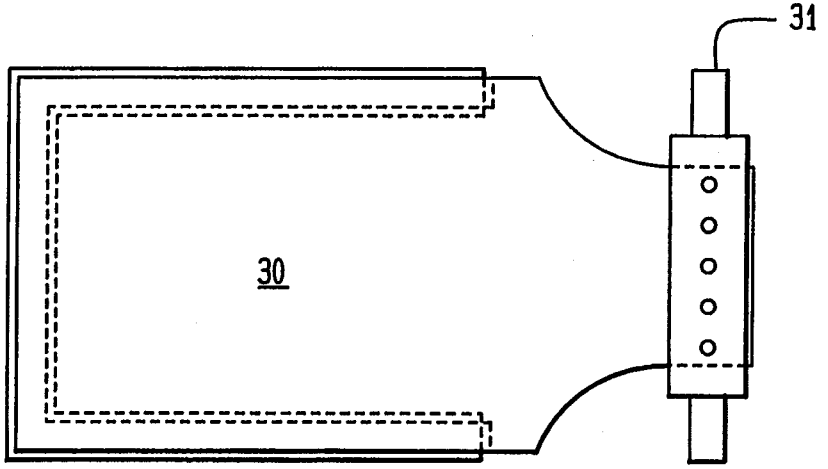
FIG. 6 is a detailed view of a blade for a rotary machine expander for the engine system of FIG. 1.
Figure 6B:
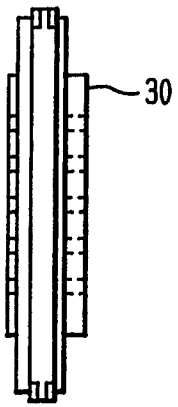
Figure 6C:
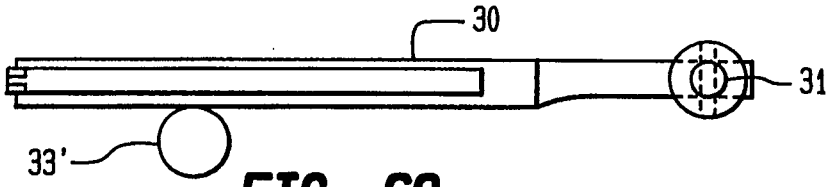

FIG. 6 shows details of the blade 30 and the shaft of the blade end bearing assemblies 31. The blade 30 is provided with a seal on the end and on the sides. Retention pins can be used to hold the blade 30 to the shaft of the blade end bearing assembly 31. A blade roller 33' is also shown for reference.

Figure 7:
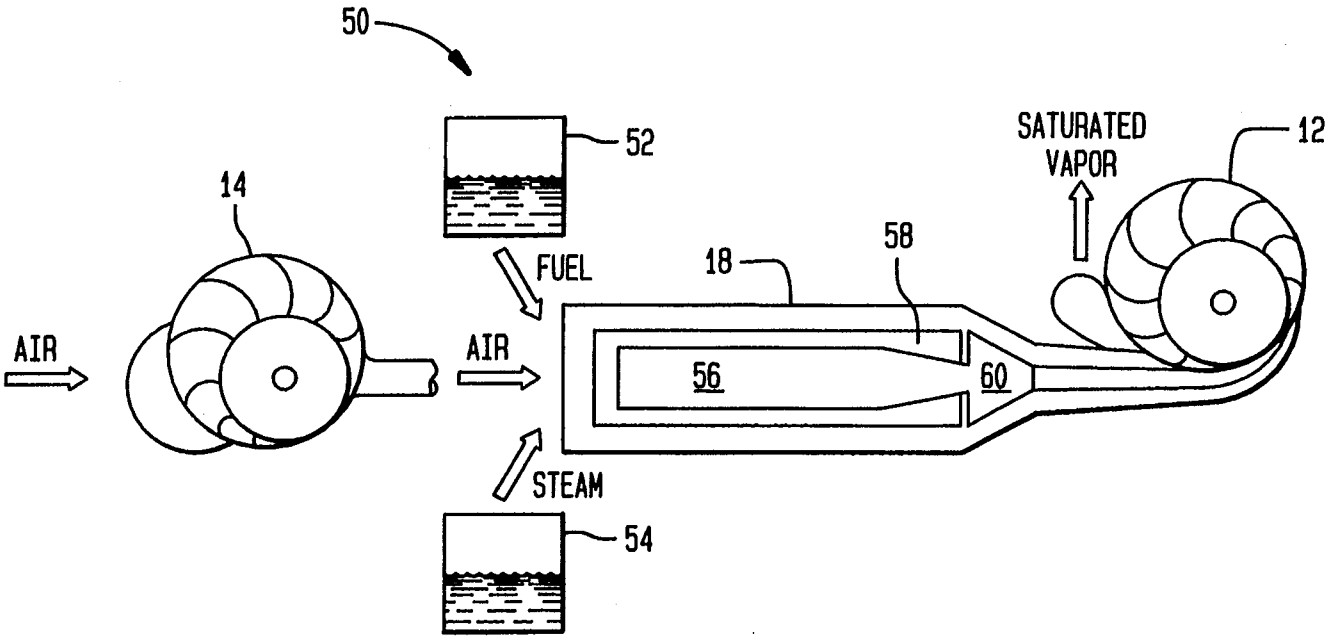
FIG. 7 is a schematic diagram illustrating a first mode of operation of a high pressure continuous combustion rotary engine system according to an exemplary embodiment of the invention.

Referring to FIG. 7, a schematic diagram 50 illustrates a method of operating the present invention. The working fluid used to turn the blades 30*a–h* of the expander 12 shown in FIG. 2 can be a burned combustible gas or can be a heated expanding gas, such as steam in a shroud around the combustor, or can be a combination of the two. If a combination is used, then heat from the combustion of the combustible gas can be used to heat the steam, thereby making use of the heat which would otherwise be a non-working byproduct of combustion. Furthermore, extracting heat from the combustion process by generating or further heating steam can cool the combustion gases, thus preventing excessively high temperature gases from striking the blades 30*a–h* and provides additional working fluid at lower operating temperatures. FIG. 7 shows the compressor 14 providing compressed air to the combustor 18. The combustor 18 is also provided with fuel 52 and steam (or water) 54.

The combustor 18 is comprised of a combustion chamber 56, a steam heater/combustion cooler 58, and a steam and exhaust mixer 60. The fuel 52 and compressed air from the compressor 14 are provided to the combustion chamber 56 which burns the fuel 52 continuously. An advantage of continuous burning of the fuel 52 in the combustion chamber 56 is that the burn temperature in the combustion chamber 56 can be maintained at a temperature that is optimal for the type of fuel that is being used. It is possible to additionally provide oxygen (not shown) to the combustion chamber 56 in order to enhance the combustion process. Also, the fuel 52 may be preheated (vaporized from a liquid to a high temperature gas), by means known to those skilled in the art, prior to injection into the combustion chamber 56 thus enhancing the combustion process. The combustor 18 is insulated to minimize thermal looses.

The steam 54 (or water, as applicable) is provided to the steam heater/combustion cooler 58 for heating by the heat generated in the combustion chamber 56. The resulting heated steam and combustion exhaust are combined in the mixer 60 and provided to the expander 12. Combining the gases is performed in a manner such that the pressures of the gases is as equal as possible during mixing in order to prevent backflow of either gas. The expander 12 uses the output of the mixer 60 to perform work as described above in connection with the detailed description of the expander 12 shown in FIG. 2 and FIG. 4. The exhaust is vented out by the expander 12.

In an exemplary embodiment of the invention, the amount of steam ranges from 10% to 90%. It is even possible to vary the relative proportions of expansion gases and combustion gases dynamically during operation of the invention. This could be useful in situations where, for example, geothermal steam or solar energy is available for use as an energy source. If the demand on the system varies, then the percentage of power provided by the geothermal steam or solar energy could also be varied by increasing or decreasing the amount of fuel provided to the system.

Figure 8:
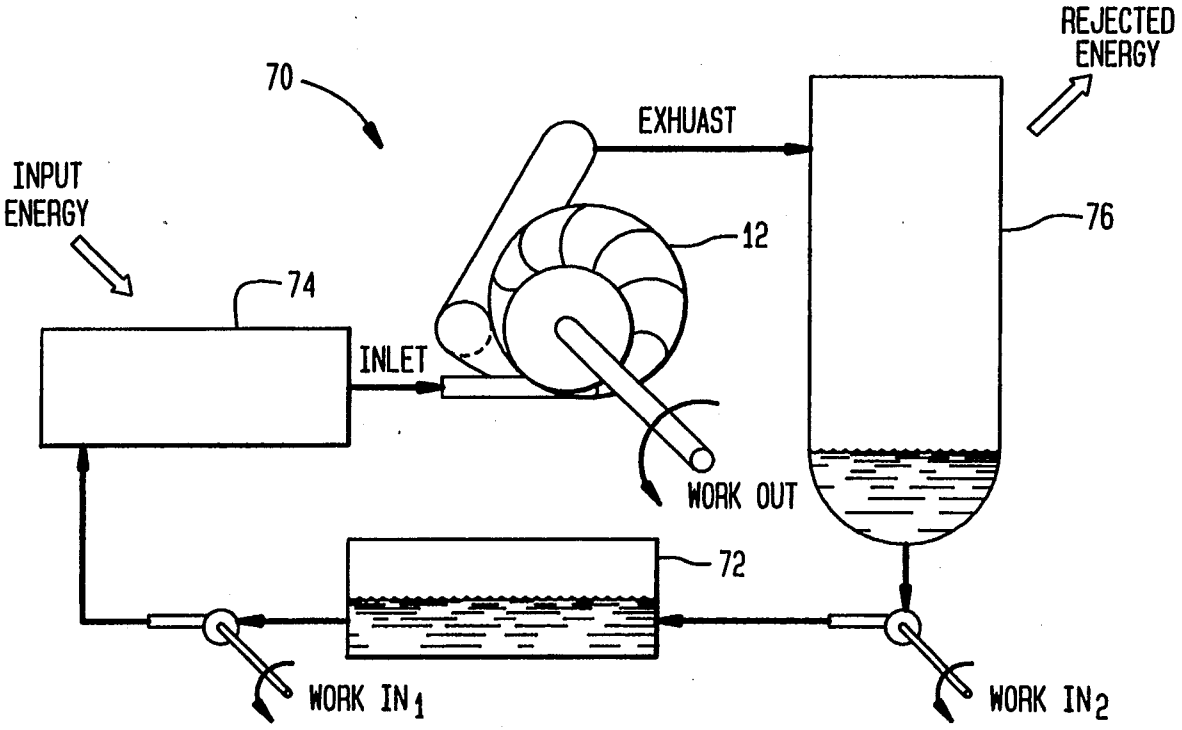
FIG. 8 is a schematic diagram illustrating a second mode of operation of a high pressure continuous combustion rotary engine system according to an exemplary embodiment of the invention.

Referring to FIG. 8, a schematic diagram 70 illustrates that the present invention can be operated in a closed cycle by heating an expanding gas (two phase working fluid), such as steam. This would be useful when a source of heat or steam, such as solar or geothermal, is readily available. A working fluid supply 72, containing an unheated, unexpanded working fluid (such as water) provides working fluid to a pump, which provides compressed fluid to an energy collector 74. The fluid is then expanded (by heating) in the energy collector 74 and provided to the expander 12.

The expanded fluid performs work in the expander 12 by means described in detail above in connection with the description of FIG. 2. The exhaust of the expander 12 is provided to a condenser 76 which cools and condenses the gas back to a liquid working fluid. The output of the condenser 76 is returned to the working fluid supply 72, thus completing the closed loop cycle. Optionally, a second pump may be interposed between the condenser 76 and the working fluid supply 72. The need for the second pump is based on a variety of functional factors known to one skilled in the art.

Figure 9:
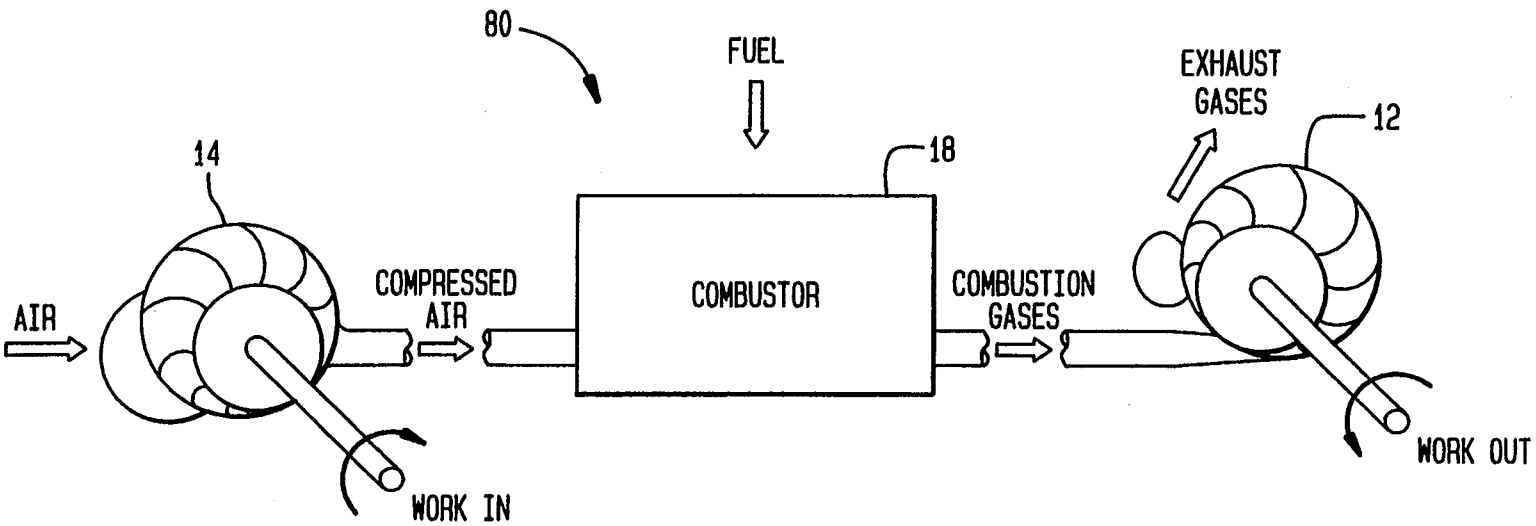
FIG. 9 is a schematic diagram illustrating a third mode of operation of a high pressure continuous combustion rotary engine system according to an exemplary embodiment of the invention.

Referring to FIG. 9, a schematic diagram 80 illustrates that the invention can be operated using only combustible expansion gases. The compressor 14 compresses air which is combined with fuel and provided to the combustor 18 for burning. The output of the combustor 18 is provided to the expander 12 and performs work in the expander 12 by means described in detail above in connection with the description associated with FIG. 2. In this configuration, the expander 12 must be capable of handling higher temperature working fluids (expanding gases).

Figure 10:
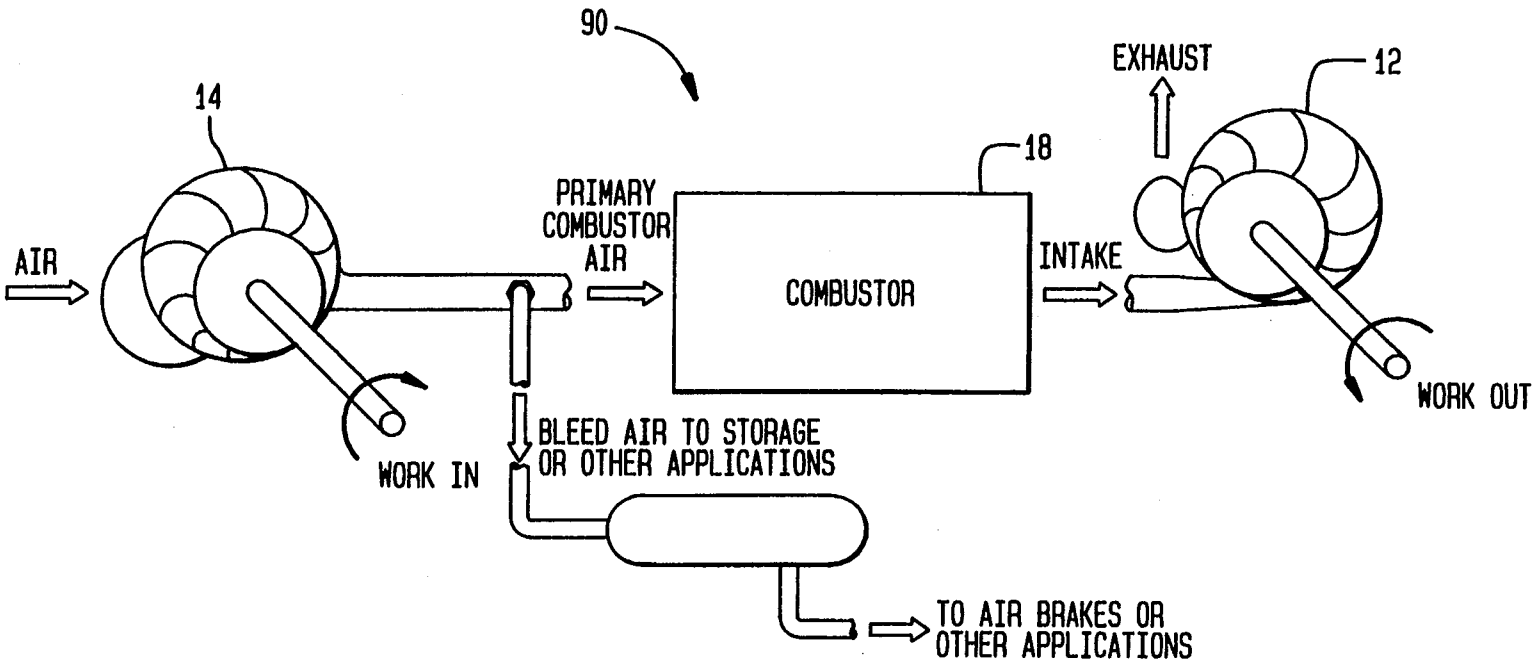
FIG. 10 is a schematic diagram illustrating a fourth mode of operation of a high pressure continuous combustion rotary engine system according to an exemplary embodiment of the invention.

Referring to FIG. 10, a schematic diagram 90 illustrates that the compressor 14 of the invention can be used to generate extra compressed air having uses other than providing compressed air to the combustor 18. The compressor 14 is made larger than needed to drive the expander 12. The extra compressed air is then bled off, by means 92 known to one skilled in the art, and then used for other purposes. In this configuration, high pressure air can be forced through a separator to create oxygen and nitrogen. The oxygen can then be provided to the combustor 18 and the nitrogen can be either provided to the condenser 102 for cooling or released to the atmosphere.

Figure 11:
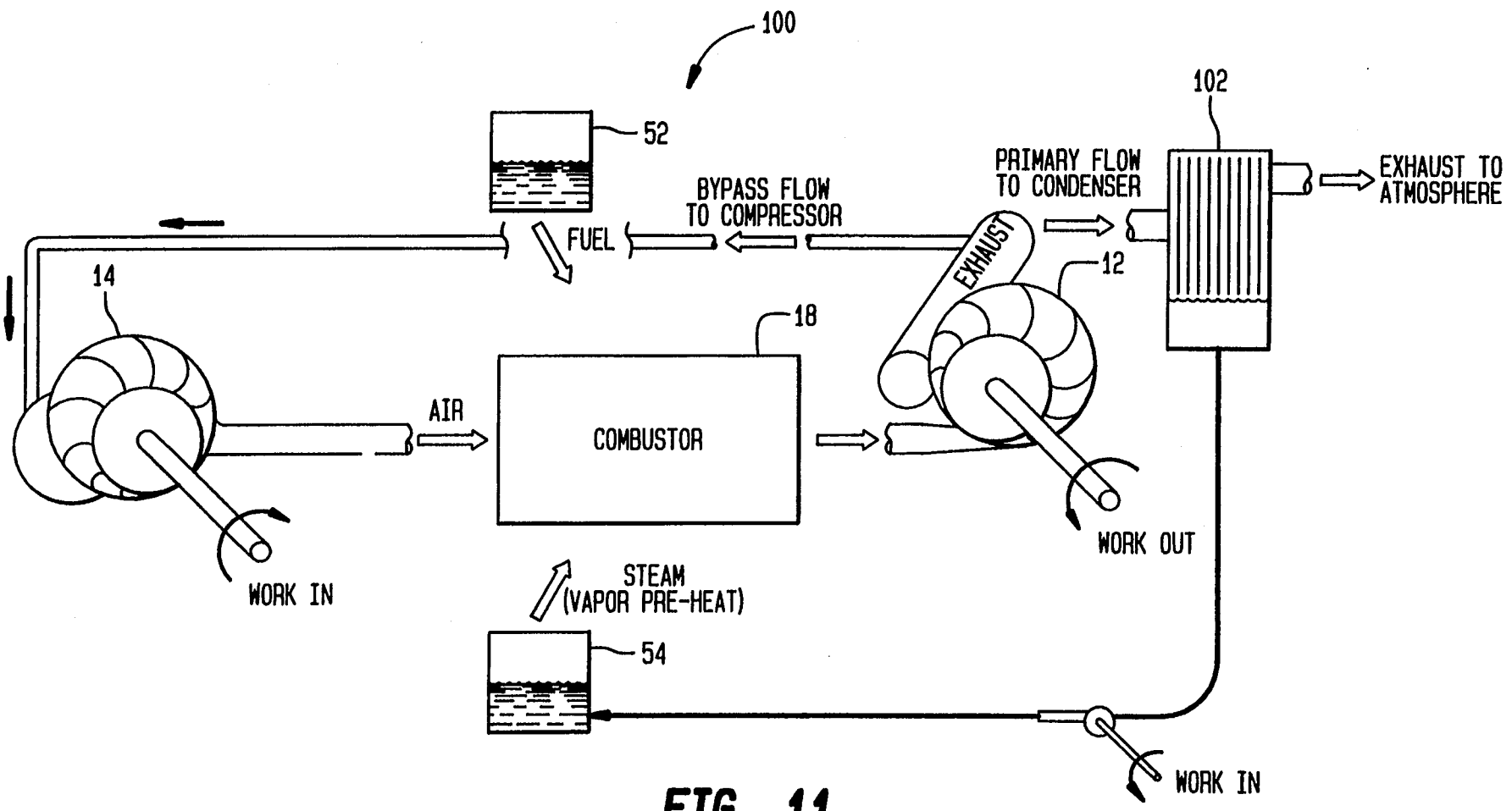
FIG. 11 is a schematic diagram illustrating a fifth mode of operation of a high pressure continuous combustion rotary engine system according to an exemplary embodiment of the invention.

Referring to FIG. 11, a schematic diagram 100 shows operation of the invention in a manner similar to that illustrated in FIG. 7 except that the steam is reclaimed to be used for another cycle. The compressor 14 compresses air which is combined with the fuel 52 and steam 54 and provided to the combustor 18. The output of the combustor 18 is provided to the expander 12, which uses the expansion gases to rotate the shaft 16, as described in detail above. However, unlike FIG. 7, the output of the expander 12 is not vented out directly. Rather, the partial output of the expander 12 is provided to a condenser 102, which condenses the steam and separates the combustion gases therefrom by means known to one skilled in the art. The condenser 102 vents the combustion gases while retaining the collected liquid. The reclaimed steam (water) is provided to the steam supply 54.

For the system shown in FIG. 11 and described above, the bypass ratio of exhaust steam is about twenty to forty percent of the total exhaust. This is fed directly back into the compressor 14 after stable combustion is achieved.

Although the invention has been illustrated herein with both an expander 12 and a compressor 14, it will be appreciated by one skilled in the art that the invention can be practiced as a stand-alone expander, a stand-alone compressor, an expander with a conventional compressor, etc.

While we have shown and described an embodiment in accordance with the present invention, it is to be understood that the same is not limited thereto but is susceptible to numerous changes and modifications as known to a person skilled in the art, and we therefore do not wish to be limited to the details shown and described herein but intend to cover all such changes and modifications as are obvious to one of ordinary skill in the art.

What is claimed:

1. A rotary device comprising:

an outer housing having an interior surface surrounding a first axis;

an outer hub assembly, dispose inside and outer housing and surrounding a second axis, said second axis being offset from said first axis;

an inner hub, disposed inside said outer hub assembly, and surrounding said first axis;

a plurality of blades, each of which extends radially from said inner hub and passes through said outer hub assembly to said interior surface of said outer housing, thereby forming a plurality of relatively airtight compartments between said interior surface of said outer housing, said outer hub assembly, and respective pairs of blades, with the volume of said compartments varying as a function of rotative position about said first axis; and a linkage arrangement, which interconnects said inner hub with said outer hub assembly exclusive of said blades, and is operative to provide mechanical drive motion between said inner hub and said outer hub assembly, in response to rotation of said inner hub about said first axis, thereby driving said outer hub assembly by said linkage arrangement therebetween, or in response to rotation of said outer hub assembly about said second axis, thereby driving said inner hub by said linkage arrangement therebetween, wherein said interior surface of said outer housing is grooved so as to allow pressure in one of said compartments to be vented through said grooved surface to another of said compartments.

2. A high pressure continuous combustion rotary engine comprising a compressor which includes a first outer housing having an interior surface surrounding a first axis, a first outer hub assembly, disposed inside said first outer housing and surrounding a second axis, said second axis being offset from said first axis, a first inner hub, disposed inside said first outer hub assembly, and surrounding said first axis, a plurality of first blades, each of which has a first portion, which engages said first inner hub such that rotation of said first inner hub about said first axis drives said first portion of each blade about said first axis, and a second portion which extends radially from said first inner hub and passes through said first outer hub assembly to said interior surface of said first outer housing such that rotation of said first outer hub assembly about said second axis drives said second portion of each blade about said second axis, so that, as said blades rotate during rotation of said first inner hub about said first axis and said first outer hub assembly about said second axis, said blades depart from extending radially about said first axis, thereby forming a plurality of relatively airtight first compartments between said interior surface of said first outer housing, said first outer hub assembly, and respective pairs of said first blades, with the volume of said first compartments varying as a function of rotative position about said first axis, and a linkage arrangement, which interconnects said first inner hub with said first outer hub assembly exclusive of said first blades, and is operative to drive said first outer assembly hub about said second axis by the rotation of said first inner hub about said first axis, said compressor further including an inlet port through which a compressible working fluid is supplied to the interior of said first housing, so as to be fed to successively adjacent ones of said first compartments during rotation of said first compartments about said first axis, and an outlet port from which said working fluid, that has been compressed as a result of a decrease in volume of said successively adjacent ones of said first compartments during rotation of said first compartments about said first axis from said inlet port to said outlet port, is vented, whereby the pressure of working fluid on the sides of said first compartments in the direction of rotation thereof increases during rotation of said first blades, thereby providing a compressed working fluid at said outlet port;

a combustion chamber to which said outlet port is coupled and being operative to effect combustion of a gas containing said compressed working fluid therein and to supply an expandable working fluid at an output thereof; and an expander which includes a second outer housing having an interior surface surrounding said first axis, a second outer hub assembly, disposed inside said second outer housing and surrounding said second axis, a second inner hub, disposed inside said second outer hub assembly, and surrounding said first axis, a plurality of second blades, each of which has a first portion, which engages said second inner hub such that rotation of said second inner hub about said first axis drives said first portion of each blade about said first axis, and a second portion which extends radially from said second inner hub and passes through said second outer hub assembly to said interior surface of said second outer housing such that rotation of said second outer hub assembly about said second axis drives said second portion of each blade about said second axis, so that, as said blades rotate during rotation of said second inner hub about said first axis and said second outer hub assembly about said second axis, said blades depart from extending radially about said first axis, thereby forming a plurality of relatively airtight second compartments between said interior surface of said second outer housing, said second outer hub assembly, and respective pairs of said second blades, with the volume of said second compartments varying as a function of rotative position about said first axis, and wherein said linkage arrangement interconnects said second inner hub with said second outer hub assembly exclusive of said second blades, and is operative to drive said second inner hub about said first axis by the rotation of said second outer hub assembly about said second axis, said expander further including an expandable working fluid inlet port through which said expandable working fluid is supplied from said combustion chamber to the interior of said second housing, so as to be fed to successively adjacent ones of said second compartments during rotation of said second compartments about said first axis, and an exhaust port from which said expandable working fluid, that has been expanded as a result of an increase in volume of said successively adjacent ones of said second compartments during rotation of said second compartments about said first axis from said expandable working fluid inlet port to said exhaust port, is vented, whereby the pressure of working fluid on the sides of said second compartments in the direction of rotation thereof decreases during rotation of said second blades, thereby providing an expanded working fluid at said exhaust port.

3. A high pressure continuous combustion rotary engine according to claim 2, wherein said linkage arrangement comprises a set of gears meshed with one another.

4. A high pressure continuous combustion rotary engine according to claim 3, wherein said set of gears is arranged so as to cause said first inner hub to rotate one revolution about said first axis for every one rotation of said first outer hub assembly, about said second axis, and so as to cause said second inner hub to rotate one revolution about said first axis for every one rotation of said second outer hub assembly about said second axis.

5. A high pressure continuous combustion rotary engine according to claim 4, wherein said first inner hub has a first radius and said first outer hub assembly has a second radius, and wherein said second radius is no smaller than the sum of said first radius and the distance between said first and second axes, and wherein said second inner hub has a third radius and said second outer hub assembly has a fourth radius, and wherein said fourth radius is no smaller than the sum of said third radius and the distance between said third and fourth axes.

6. A high pressure continuous combustion rotary engine according to claim 2, wherein a respective first blade of said plurality of first blades has a first end which is hingedly connected to said first inner hub about a respective third axis passing through said first end of said respective first blade, and a second end which contacts said interior surface of said first outer housing, and wherein a respective second blade of said plurality of second blades has a first end which is hingedly connected to said second inner hub about a respective fourth axis passing through said first end of said respective second blade, and a second end which contacts said interior surface of said second outer housing.

7. A high pressure continuous combustion rotary engine according to claim 6, wherein said first outer hub assembly has a plurality of first slots, and wherein respective ones of said first blades pass in airtight sealing engagement through respective ones of said first slots, and wherein said outer hub assembly has a plurality of second slots, and wherein respective ones of said blades pass in airtight sealing engagement through respective ones of said second slots.

8. A high pressure continuous combustion rotary engine according to claim 7, wherein said first outer hub assembly includes a plurality of first blade spreader elements separated from one another by way of respective ones of said first slots, and wherein a respective first blade spreader element includes a roller element at a first end thereof and a sealing element at a second end thereof, so that one side of a respective first blade is engaged by a sealing element of one of said first blade spreader elements and a second side of said respective first blade is engaged by a roller element of another of said first blade spreader elements, and wherein said second outer hub assembly includes a plurality of second blade spreader elements separated from one another by way of respective ones of said second slots, and wherein a respective second blade spreader element includes a roller element at a first end thereof and a sealing element at a second end thereof, so that one side of a respective second blade is engaged by a sealing element of one of said second blade spreader elements and a second side of said respective second blade is engaged by a roller element of another of said second blade spreader elements.

9. A high pressure continuous combustion rotary engine according to claim 2, wherein said expandable working fluid contains a combustion gas and steam.

10. A high pressure continuous combustion rotary engine according to claim 2, wherein said combustor is operative to combine an expansion fluid which is mixed with a burning gas before being provided as said expandable working fluid to the inlet port of said expander.

11. A high pressure continuous combustion rotary engine according to claim 10, wherein said expansion fluid includes water.

12. A high pressure continuous combustion rotary engine according to claim 2, wherein said first and second inner hubs are connected with a common drive shaft.

13. A high pressure continuous combustion rotary engine according to claim 2, wherein said first blades of said compressor have respective blade areas which are less than blade areas of said second blades of said expander.

14. A high pressure continuous combustion rotary engine according to claim 13, wherein said first blades of said compressor have respective blade areas which are on the order of one-third of blade areas of said second blades of said expander.

15. A high pressure continuous combustion rotary engine according to claim 2, wherein the interior surface of at least one of said first and second outer housings is grooved so as to allow pressure in at least one of said first and second compartments to be vented through said grooved surface to another of said compartments.

16. A rotary device comprising:

an outer housing having an interior surface surrounding a first axis;

an outer hub assembly, disposed inside said outer housing and surrounding a second axis, said second axis being offset from said first axis;

an inner hub, disposed inside said outer hub assembly, and surrounding said first axis;

a plurality of blades, each of which has a first portion, which engages said inner hub such that rotation of said inner hub about said first axis drives said first portion of each blade about said first axis, and a second portion which extends radially from said inner hub and passes through said outer hub assembly to said interior surface of said outer housing such that rotation of said outer hub assembly about said second axis drives said second portion of each blade about said second axis, so that, as said blades rotate during rotation of said inner hub about said first axis and said outer hub assembly about said second axis, said blades depart from extending radially about said first axis, thereby forming a plurality of relatively airtight compartments between said interior surface of said outer housing, said outer hub assembly, and respective pairs of blades, with the volume of said compartments varying as a function of rotative position about said first axis; and a linkage arrangement, which interconnects said inner hub with said outer hub assembly exclusive of said blades, and is operative to provide mechanical drive motion between said inner hub and said outer hub assembly, in response to rotation of said inner hub about said first axis, thereby driving said outer hub assembly by said linkage arrangement therebetween, or in response to rotation of said outer hub assembly about said second axis, thereby driving said inner hub by said linkage arrangement therebetween; and further comprising an inlet port through which a combustion gas is continuously supplied to the interior of said housing from a combustion chamber external of said housing, so as to be fed to successively adjacent ones of said compartments during rotation of said compartments about said first axis, and an exhaust port from which said combustion gas is vented subsequent to rotation of said compartments about said first axis from said inlet port to said exhaust port; and wherein said interior surface of said outer housing is grooved so as to allow pressure in one of said compartments to be vented through said grooved surface to another of said compartments and thereby adjust the pressure differential on blades preceding said exhaust port.

17. A rotary device comprising:

an outer housing having an interior surface surrounding a first axis;

an outer hub assembly, disposed inside said outer housing and surrounding a second axis, said second axis being offset from said first axis;

an inner hub, disposed inside said outer hub assembly, and surrounding said first axis;

a plurality of blades, each of which has a first portion, which engages said inner hub such that rotation of said inner hub about said first axis drives said first portion of each blade about said first axis, and a second portion which extends radially from said inner hub and passes through said outer hub assembly to said interior surface of said outer housing such that rotation of said outer hub assembly about said second axis drives said second portion of each blade about said second axis, so that, as said blades rotate during rotation of said inner hub about said first axis and said outer hub assembly about said second axis, said blades depart from extending radially about said first axis, thereby forming a plurality of relatively airtight compartments between said interior surface of said outer housing, said outer hub assembly, and respective pairs of blades, with the volume of said compartments varying as a function of rotative position about said first axis; and a linkage arrangement, which interconnects said inner hub with said outer hub assembly exclusive of said blades, and is operative to provide mechanical drive motion between said inner hub and said outer hub assembly, in response to rotation of said inner hub about said first axis, thereby driving said outer hub assembly by said linkage arrangement therebetween, or in response to rotation of said outer hub assembly about said second axis, thereby driving said inner hub by said linkage arrangement therebetween; and further comprising an inlet port through which a compressible working fluid is supplied to the interior of said housing, so as to be fed to successively adjacent ones of said compartments during rotation of said compartments about said first axis, and an outlet port from which said working fluid, that has been compressed as a result of a decrease in volume of said successively adjacent ones of said compartments during rotation of said compartments about said first axis from said inlet port to said outer port, is vented, whereby the pressure of working fluid on the sides of said compartments in the direction of rotation thereof increases during rotation of said blades, thereby providing a compressed working fluid at said outlet port; and wherein said interior surface of said outer housing is grooved so as to allow pressure in one of said compartments to be vented through said grooved surface to another of said compartments and thereby adjust the pressure differential on blades preceding said outlet port.

* * * * *